US007969359B2

(12) United States Patent
Krishnaswamy et al.

(10) Patent No.: US 7,969,359 B2
(45) Date of Patent: Jun. 28, 2011

(54) REFLECTIVE PHASE SHIFTER AND METHOD OF PHASE SHIFTING USING A HYBRID COUPLER WITH VERTICAL COUPLING

(75) Inventors: Harish Krishnaswamy, Los Angeles, CA (US); Arun Sridhar Natarajan, White Plains, NY (US); Alberto Valdes Garcia, Hartsdale, NY (US)

(73) Assignee: International Business Machines Corporation, Armonk, NY (US)

( * ) Notice: Subject to any disclaimer, the term of this patent is extended or adjusted under 35 U.S.C. 154(b) by 120 days.

(21) Appl. No.: 12/348,163

(22) Filed: Jan. 2, 2009

(65) Prior Publication Data

US 2010/0171567 A1 Jul. 8, 2010

(51) Int. Cl.
*H01Q 3/36* (2006.01)
*H01P 1/18* (2006.01)

(52) U.S. Cl. ..... 342/372

(58) Field of Classification Search ..... 333/164, 333/139, 156, 161, 116, 117; 342/372
See application file for complete search history.

(56) References Cited

U.S. PATENT DOCUMENTS 5,589,845 A * 12/1996 Yandrofski et al. ..... 343/909
6,664,869 B2 * 12/2003 Hershtig ..... 333/156
2008/0197936 A1 * 8/2008 Berg ..... 333/103

OTHER PUBLICATIONS

C. T. Charles et al., A 2-GHz Integrated CMOS Reflective-type Phase Shifter with 675o Control Range, In Proc. IEEE International Symposium on Circuits and Systems, May 2006, pp. 381-384.

Kim et al., A Compact V-Band 2-Bit Reflection-Type MEMS Phase Shifter, IEEE Microwave and Wireless Components Letters, vol. 12, No. 9; Sep. 2002; pp. 324-326.

Konishi et al., A Directional Coupler of a Vertically Installed Planar Circuit Structure; IEEE Transactions on Microwave Theory and Techniques, vol. 36, No. 6; Jun. 1988; pp. 1057-1063.

Jamel S. Izadian, A New 6-18GHz, -3DB Multisection Hybrid Coupler Using Asymmetric Broadside, and Edge Coupled Lines; IEEE MTT-S Digest; 1989; pp. 243-246.

Lee et al., A Broadband Single Balanced Diode Mixer Using a Wideband Rat-Race Hybrid wit Vertical Coupling Structure, APMC 2005 Proceedings; 2005; 4 pages.

Bulia et al., A New Structure for Reflection-type Phase Shifter with 360°, Phase Control Range; Microwave Conference, 2005 European; vol. 3, Issue , Oct. 4-6, 2005; 4 pages.

(Continued)

*Primary Examiner* — Benny Lee
(74) *Attorney, Agent, or Firm* — Tutunjian & Bitetto, PC.; Anne V. Dougherty, Esq.

(57) ABSTRACT

A phase shifter and method include a hybrid coupler being ground shielded. The hybrid coupler with reflective terminations connected to the hybrid coupler is configured to phase shift an applied signal wherein the reflective terminations include a parallel LC circuit.

24 Claims, 9 Drawing Sheets

OTHER PUBLICATIONS

Miyaguchi et al., An Ultra-Broad-Band Reflection-Type Phase-Shifter MMIC With Series and Paralle C Circuits; IEEE Transactions on Microwave Theory; vol. 49, No. 12; Dec. 2001; pp. 2446-2452.
Koul et al., Broadside, Edge-Coupled, Symmetric Strip Transmission Lines; IEEE Transactions on Microwave Theory and Techniques, vol. 30, No. 11; Nov. 1982; pp. 1874-1880.
J. W. Duncan, Characteristic Impedances of Multiconductor Strip Transmission Lines; Microwave Theory and Techniques, vol. 13, Issue 1; Jan. 1965; pp. 107-118.
Zarei et al., Reflective-Type Phase Shifters for Multiple-Antenna Transceivers; IEEE Transactions on Circuits and Systems -I:Regular Papers, vol. 54, No. 8; Aug. 2007; pp. 1647-1656.
Ho et al., Slot-Coupled Double=Sided Microstrip Interconnects and Couplers; IEEE MIT-S Digest; 1993; pp. 1321-1324.
Lucyszyn et al., Synthesis Techniques for High Performance Octave Bandwidth 180° Analog Phase Shifters; IEEE Transactions on Microwave Theory and Techniques; vol. 40. No. 4; Apr. 1992; pp. 731-740.

* cited by examiner

REFLECTIVE PHASE SHIFTER AND METHOD OF PHASE SHIFTING USING A HYBRID COUPLER WITH VERTICAL COUPLING

BACKGROUND

1. Technical Field

The present invention relates to radio-frequency phase shifters and more particularly to phase shifters operating at millimeter-wave frequencies for integrated phased arrays systems.

2. Description of the Related Art

Phase sifters and phased arrays are now presented in a context which illustrates their requirements for monolithic integration and the existing implementations. Phased Array Systems: Phased array transceivers are a class of multiple antenna systems that achieve spatial selectivity through control of the time delay differences between successive antenna signal paths. A change in this delay difference modifies the direction in which the transmitted/received signals add coherently, thus "steering" the electromagnetic beam. The integration of phased-arrays in silicon-based technologies has aroused great interest in recent times due to potential applications in high-speed wireless communication systems and radar.

There are several prominent commercial applications of phased arrays at millimeter-wave frequencies. The 7 GHz Industrial, Scientific and Medical (ISM) band at 60 GHz is currently being widely investigated for indoor, multi-gigabit per second Wireless Personal Area Networks (WPANs). In such an application, the line-of-sight link between the transmitter and receiver can easily be broken due to obstacles in the path. Phased arrays can harness reflections off the walls due to their beam-steering capability, thus allowing the link to be restored.

Referring to FIG. 1A, a block diagram illustrates a 1-D N-element phased array receiver 10, with an inter-element antenna spacing of $d=\lambda/2$, where $\lambda$ is the free-space wavelength corresponding to the frequency of operation, $\omega$. When a signal 12 of amplitude A from an electromagnetic beam is incident to the array 10 at an angle $\theta_{in}$ (measured from the normal direction), the electromagnetic wave experiences a time delay in reaching the successive antennas 16 from the phase gap indicated by dsin(θin). Variable time delay blocks 14 in each signal path in the receiver compensate for this propagation delay. In this way, with appropriate delays at each element, where the outputs of the elements are labeled $S_1(t)$ through $S_N(t)$, the combined or summed output signal Scomb(t) from summer 18 will have a larger amplitude than it could be obtain with a single element. The phased array factor (AF), in the context of receivers, is defined as the additional power gain achieved by the array over a single-element receiver.

The phased array factor is a function of the angle of incidence ($\theta$) and the array's progressive delay difference ($\tau$), and hence reflects the spatial selectivity of the array. The beam-pointing direction $\theta_m$ is the incident angle corresponding to maximum power gain. FIG. 1B shows an array factor of a 4-element phased array for different $\Delta\tau$ settings, resulting in different beam-pointing directions. The curves measure the response of the four different elements in the array.

SUMMARY

An integrated reflective-type differential phase shifter includes a vertical coupled line hybrid and inductive-capacitive (LC) resonant loads. The hybrid coupler includes differential coplanar striplines (CPS) placed one on top of the other using different metal layers so that the coupling occurs vertically. This reduces the employed area and allows an easier differential implementation. The widths of the CPS are not identical, this feature allows more flexibility to set their characteristic impedances. At a lower metal level (e.g. M1), metal strips are placed orthogonally with respect to the CPS as shielding to reduce the substrate loss. These metal strips are also designed to reduce the wave propagation speed in the CPS and reduce the overall size of the coupler. The reflective load terminations for the hybrid coupler are implemented with a parallel resonant LC circuit. The inductor sets the imaginary part of the reflective load impedance to a value where a change in capacitance yields a larger change in phase for the overall phase shifter. This structure is suitable for mmWave as the capacitive parasitic of the inductor can be absorbed into the shunt inductor value. The implementation features are suitable for integration in SiGe and CMOS technologies, and operation at mmWave frequencies.

In a differential embodiment. A hybrid coupler having differential coplanar striplines (CPS) placed one on top of the other using different metal layers so that the coupling occurs vertically is included. This reduces the employed area and allows an easier differential implementation. The widths of the CPS are not identical. This feature allows more flexibility to set their characteristic impedances. At a lower metal level (e.g. M1), metal strips are placed orthogonally with respect to the CPS as shielding to reduce the substrate loss. These metal strips are also designed to reduce the wave propagation speed in the CPS and reduce the overall size of the coupler.

In a single-ended embodiment: The coupler includes coupled lines placed over/under metal strips that are orthogonal to the coupled lines. The strips shield and improve coupling, isolation with smaller coupler size and higher characteristic impedance.

A method for phase shifting a transmitted signal includes distributing a signal to one or more antennae, phase shifting the signal by an amount dependent on a phase shifter associated with each antennae, the phase shifter including a hybrid coupler being ground shielded and reflective terminations connected to the hybrid coupler, wherein the reflective terminations include a parallel LC circuit and transmitting the phase shifted signals from the one or more antennae to provide spatial selectivity through phase shifted differences.

These and other features and advantages will become apparent from the following detailed description of illustrative embodiments thereof, which is to be read in connection with the accompanying drawings.

BRIEF DESCRIPTION OF DRAWINGS

The disclosure will provide details in the following description of preferred embodiments with reference to the following figures wherein.

DETAILED DESCRIPTION OF PREFERRED EMBODIMENTS

Figure 1A:
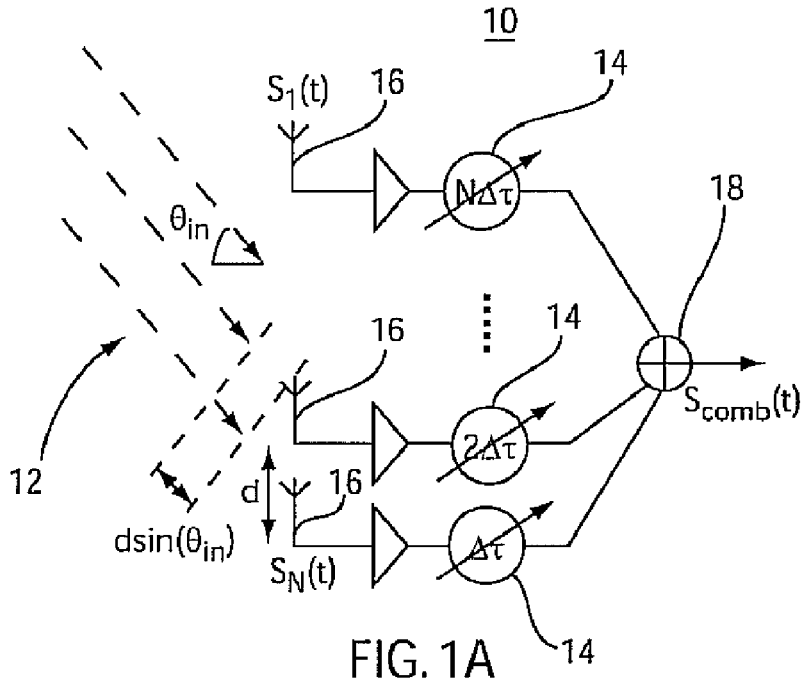
FIG. 1A (Prior Art)
FIG. 1A is a block diagram showing a phase array receiver in accordance with the prior art.
Figure 1B:
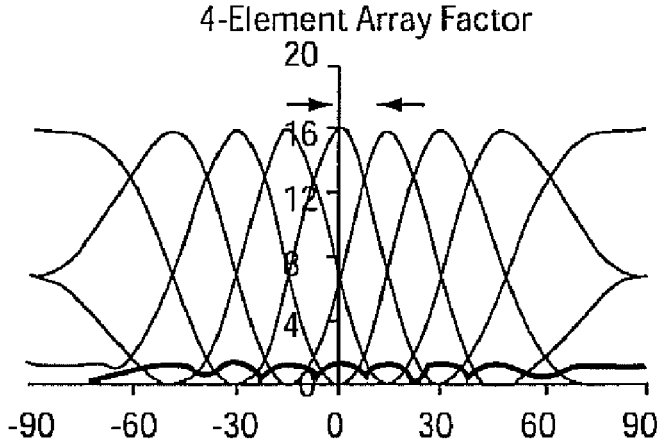
FIG. 1B (Prior Art)
FIG. 1B is a graph plotting 4-element array factor (AF) versus angle of incidence for different settings of 3-bit delay elements in accordance with the prior art.

In accordance with the present principles, a ground-shielded coupled-line coupler is integrated with LC parallel resonant reflective loads to form a Reflection-type Phase Shifter (RTPS) which is suitable for a silicon implementation and operation at mmWave frequencies. Both, single-ended and differential embodiments are considered. A coupled-line coupler is chosen to provide a wider bandwidth of operation over other alternatives (e.g. branch-line coupler). Even mode and odd mode impedances that can be obtained with this coupler in an integrated implementation are adequate for a Reflection-type Phase Shifter (RTPS) at mmWave frequencies. In the differential case, the coupler in one embodiment includes differential coplanar striplines (CPS) placed one on top of the other using different metal layers so that the coupling occurs vertically. This reduces the employed area and permits an easier differential implementation. In the single-ended case, the coupler in accordance with one embodiment includes coupled lines placed over/tinder metal strips that are orthogonal to the coupled lines. The strips shield and improve coupling isolation with smaller coupler size and higher characteristic impedance.

In other embodiments, the reflective load terminations for a hybrid coupler in both, the single-ended and the differential embodiments, are implemented with a parallel resonant LC circuit. The limited variation in capacitance of varactors in silicon technologies restricts the phase shift variation achievable in an RTPS. In the present embodiments, the inductor sets the imaginary part of the reflective load impedance to a value where a change in capacitance yields a larger change in phase. This structure is suitable for mmWave as the capacitive parasitic of the inductor can be absorbed into the shunt inductor value.

Embodiments of the present invention can take the form of an entirely hardware embodiment or an embodiment including both hardware and software elements (which include but are not limited to firmware, resident software, microcode, etc.).

Embodiments as described herein may be a part of the design for an integrated circuit chip, an optical bench, a transmitter or receiver or any other apparatus or device that employs radio-transmissions or wireless communications. Chip designs may be created in a graphical computer programming language, and stored in a computer storage medium (such as a disk, tape, physical hard drive, or virtual hard drive such as in a storage access network). If the designer does not fabricate chips or the photolithographic masks used to fabricate chips, the designer transmits the resulting design by physical means (e.g., by providing a copy of the storage medium storing the design) or electronically (e.g., through the Internet) to such entities, directly or indirectly. The stored design is then converted into the appropriate format (e.g., Graphic Data System IT (GDSII)) for the fabrication of photolithographic masks, which typically include multiple copies of the chip design in question that are to be formed on a wafer. The photolithographic masks are utilized to define areas of the wafer (and/or the layers thereon) to be etched or otherwise processed.

The resulting integrated circuit chips can be distributed by the fabricator in raw wafer form (that is, as a single wafer that has multiple unpackaged chips), as a bare die, or in a packaged form. In the latter case the chip is mounted in a single chip package (such as a plastic carrier, with leads that are affixed to a motherboard or other higher level carrier) or in a multichip package (such as a ceramic carrier that has either or both surface interconnections or buried interconnections). In any case the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

Figure 2:
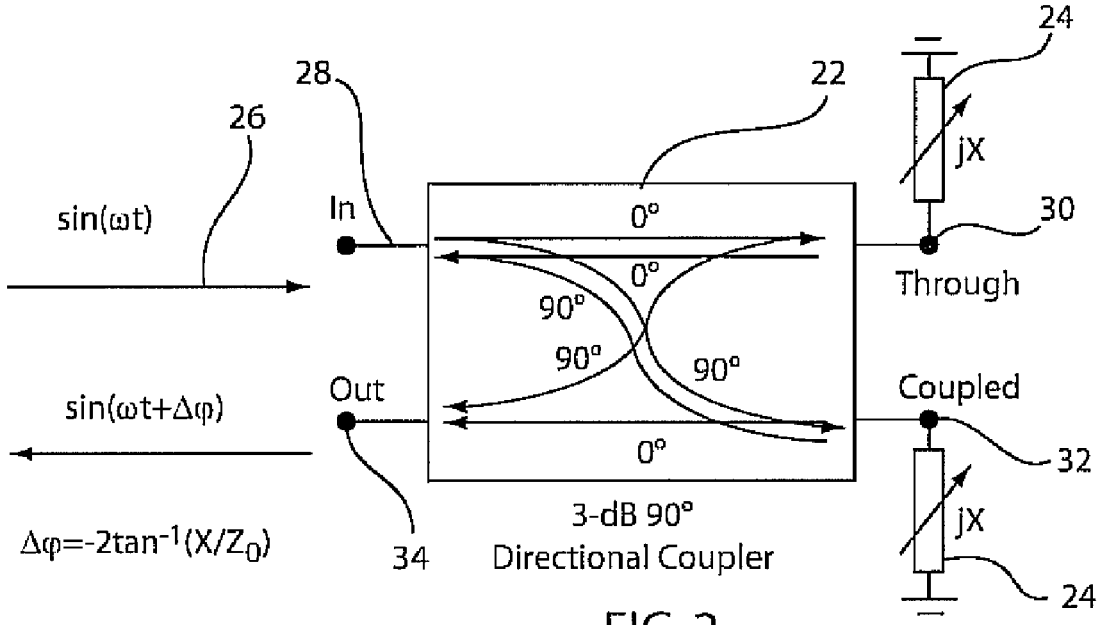
FIG. 2 is a diagram showing a reflection-type phase shifter.

Referring now to the drawings in which like numerals represent the same or similar elements and initially to FIG. 2, a general block diagram of a Reflection-type Phase Shifter (RTPS) is depicted. The RTPS includes a 3 dB, 90° hybrid coupler 22 and purely reactive, variable load terminations 24. When an input signal $\sin(\omega t)$ 26 is incident on an input port 28 of the RTPS, it splits into two components of equal power that reach the through and coupled outputs 30 and 32 with a 90° phase difference. At these ports 30 and 32, the signals undergo perfect reflection due to the reactive nature of the terminations 24. This perfect reflection is accompanied by a phase shift that depends on the value of the variable reactive jX loads 24. The reflected signals then combine coherently at an output port 34 (which is the isolated port of the coupler) to produce a signal $\sin(\omega t+\Delta\phi)$, where $\Delta\phi=2\tan^{-1}(X/Z_0)$, because the 90° phase shift between the input and coupled ports is balanced by a 90° shift between the through and output ports 30 and 32. The reflected signals combine destructively at the input port 28 as the reflected signal from the coupled port suffers an additional 90° shift.

The two main sources of loss in the RTPS are the losses in the transmission lines used to implement the coupler 22, and the losses in the reflective terminations 24. The finite quality factor of on-chip reactive components introduces a resistive component in the reflective termination. This causes the reflection to be imperfect, thus introducing loss. 3-dB 90° hybrid couplers can be implemented using coupled transmission lines.

Figure 3:
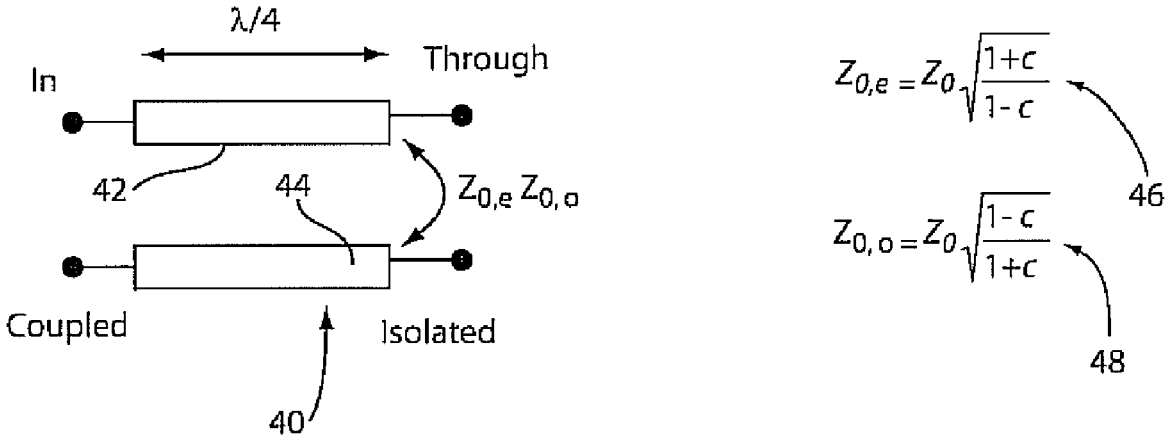
FIG. 3 is a diagram showing a quadrature hybrid based on coupled transmission lines and design equations for the odd mode and even mode characteristic impedances.

Referring to FIG. 3, a two-coupled-line coupler 40 is illustratively depicted. For proper functioning, the even and odd mode characteristic impedances, $Z_{0,e}$ and $Z_{0,o}$, of the coupled transmission lines 42 and 44 must be given according to the equations 46 and 48. The coupling factor c is 0.7 for a 3 dB coupler. In addition, the wavelengths must be equal in the even and odd modes, and the length of the coupled transmission lines must be a quarter of that value. The design of the reflective terminations also requires careful consideration. The phase shift of the RTPS at the design frequency is the effective capacitance at the reflective terminations.

Figure 4A:
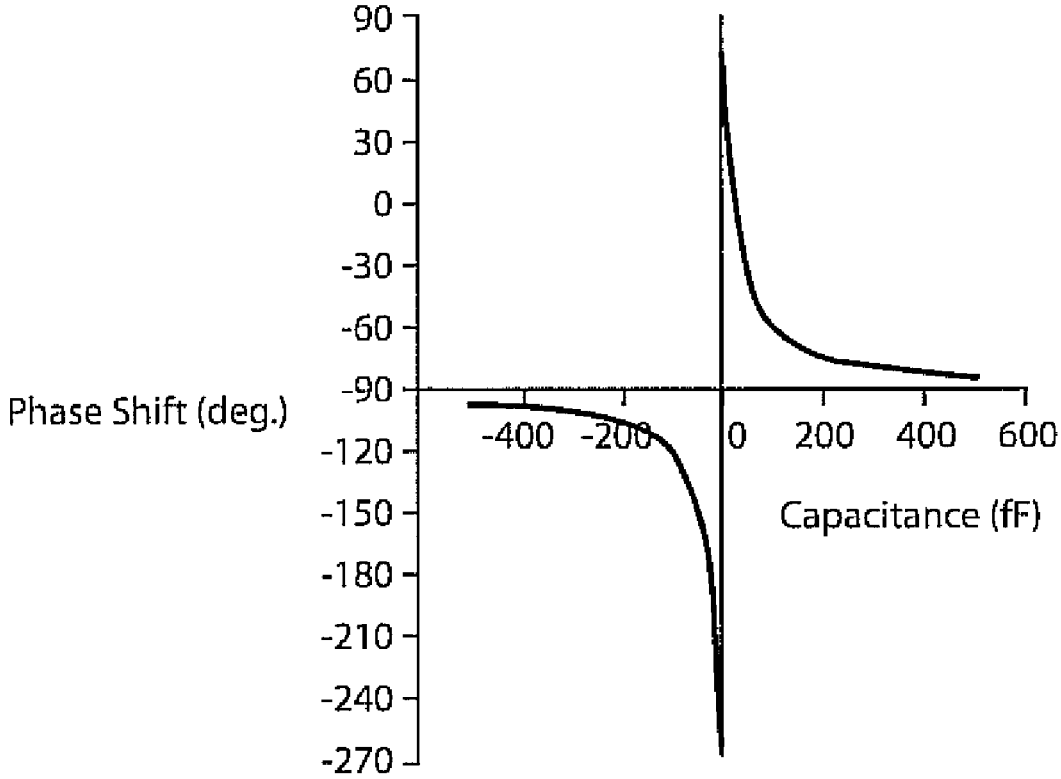
FIG. 4A is a graph of phase shift versus capacitance of reflective terminations for a 60 Hz reflection-type phase shifter.
Figure 4B:
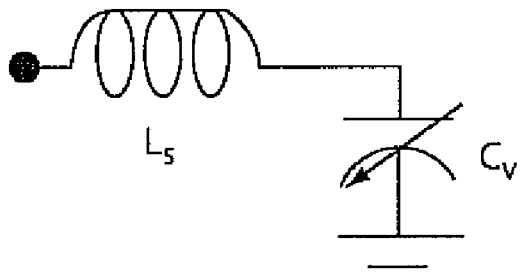
FIG. 4B is a series LC circuit which may be employed in reflective terminations.

Referring to FIG. 4A, phase shift dependence on capacitance is illustratively shown. If the reflective terminations are implemented using only varactors, to achieve 180° phase-shift range, the varactor's capacitance must vary from 0 to ∞. To overcome this problem, higher-order reflective terminations may be employed. An example is shown in FIG. 4B where an inductor (Ls) is connected in series to a varactor (Cv) to form the reflective termination. Using these concepts and improved phase shifter is provided in accordance with the present principles.

Figure 5:
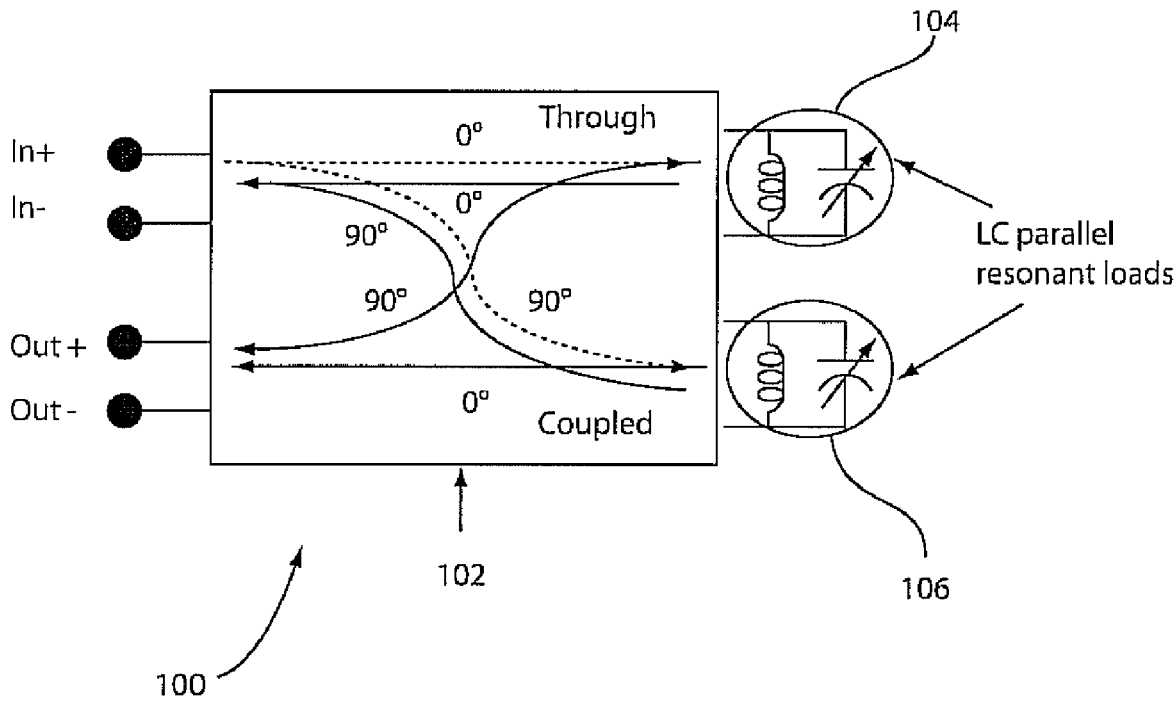
FIG. 5 is a block diagram of a phase shifter according to the present principles.

Referring to FIG. 5, a block diagram illustratively shows a phase shifter 100 in accordance with the present principles. A ground-shielded coupled-line coupler 102 is integrated with LC parallel resonant reflective loads 104 and 106 to form an RTPS which is suitable for a silicon implementation and operation at mmWave frequencies. A coupled-line coupler 102 having a plus and a minus port for both the input and the output (In+, In−, Out+, Out−) is chosen to provide a wider bandwidth of operation over other alternatives (e.g. branch-line coupler). The even mode and odd mode impedances 104 and 106 that can be obtained with this coupler 102 in an integrated implementation are adequate for a RTPS at mmWave frequencies. In a differential case, the coupler may include differential coplanar striplines (CPS) placed one on top of the other using different metal layers so that the coupling occurs vertically. This reduces the employed area and allows an easier differential implementation. In the single-ended case, the coupler includes coupled lines placed over/under metal strips that are orthogonal to the coupled lines.

The reflective load terminations 104 and 106 for the hybrid coupler in both, the single-ended and the differential embodiments, are preferably implemented with a parallel resonant LC circuit. The limited variation in capacitance of varactors in silicon technologies restricts the phase shift variation achievable in an RTPS. The inductor sets the imaginary part of the reflective load impedance to a value where a change in capacitance yields a larger change in phase. This structure is suitable for mmWaves as the capacitive parasitic of the inductor can be absorbed into the shunt inductor value.

The coupler 102 performs 90 degree phase shifts between its ports in/out. To operate as a phase shifter (e.g. for an arbitrary phase), the coupler 102 is connected to reflective loads 104 and 106. The coupler 102 is designed to form part of a phase shifter and attain good performance, especially in integrated implementations.

Figure 6:
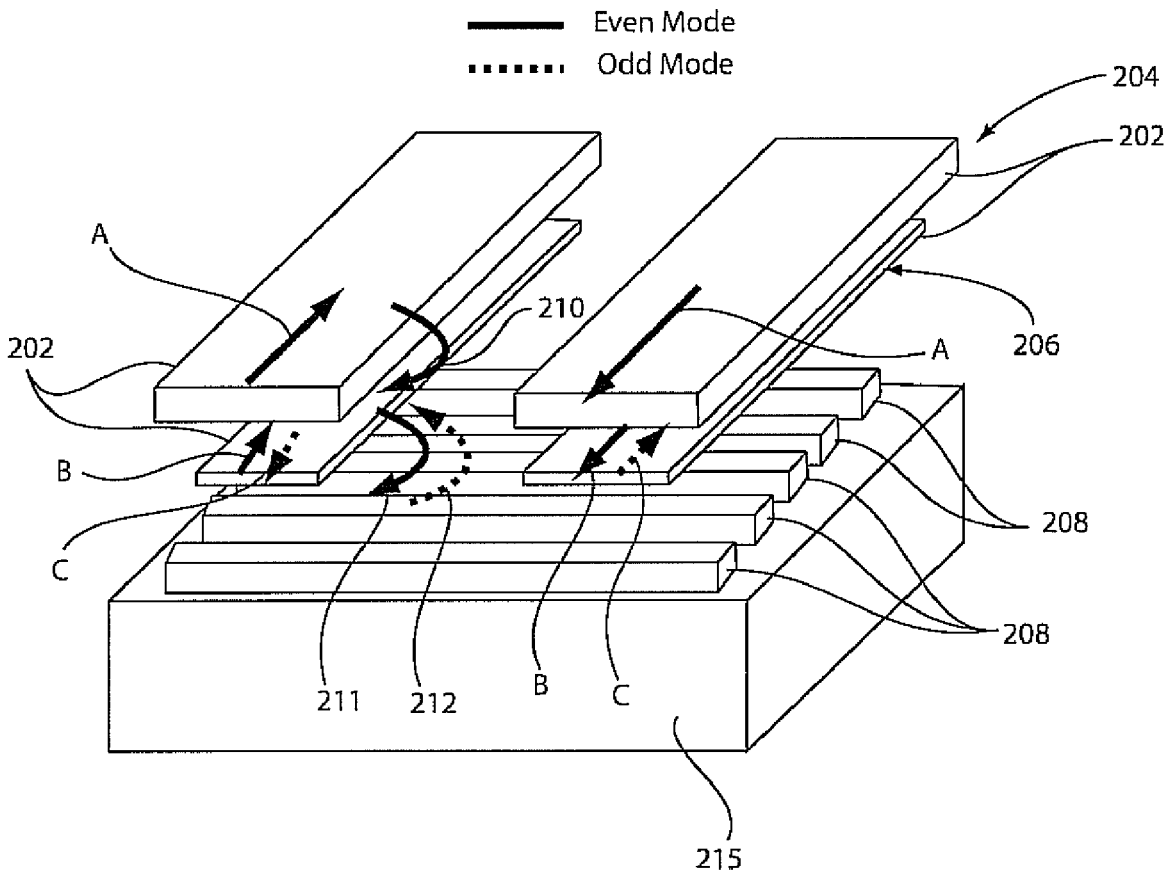
FIG. 6 illustratively shows a section of a differential coupler realized through vertically-coupled Coplanar Striplines (CPS) in accordance with the present principles.

Referring to FIG. 6, a section of a differential vertical coupled-line coupler 200 is illustratively depicted. In this embodiment, coplanar striplines (CPS) 202 are implemented in the two different metal layers 204 and 206 (henceforth referred to as signal metal layers) and the vertical coupling 210 between them is exploited. In the even mode, when the currents (arrows A and B) in the two CPS's are parallel, the magnetic fields in between the lines add (line 211), thus increasing the inductance per unit length and characteristic impedance of each line. In odd mode, the magnetic fields cancel due to currents (arrows A and C), thus reducing the inductance per unit length of each line (line 212). Moreover, there is a significant parallel-plate capacitance between the two lines 202 of layers 204 and 206 that reduces the characteristic impedances.

Shielding metal strips (e.g., strips 208) are implemented in a metal layer or multiple layers different from the two aforementioned metal layers 204 and 206 to isolate the lines 202 from the lossy silicon substrate 215. As a result of this shielding, in both even and odd mode, there is a higher capacitance seen on the signal layer closer to the shield layer. To balance this effect and maintain equal impedances in both even and odd modes, in accordance with one aspect of the present principles, the width of one of the signal metal level CPS (206) is reduced with respect to that of the other signal metal CPS (204).

It should be understood that particularly useful embodiments have the coupler 200 formed on substrate 215. The substrate 215 may include a silicon substrate, SiGe or any other suitable substrate material. The formation of the differential or single-ended embodiments is preferably contemplated for silicon integration using semiconductor processing operations. Metal layers may be deposited and etched using integrated circuit processing similar to CMOS type integrations. Formation of features can be performed with high accuracy. For example, the width and spacing of the coupled CPSes may be chosen to achieve the desired characteristic impedances. In addition, shielding strips are placed in a metal layer (e.g., M1) to reduce substrate loss and the size of the coupler.

Figure 7A:
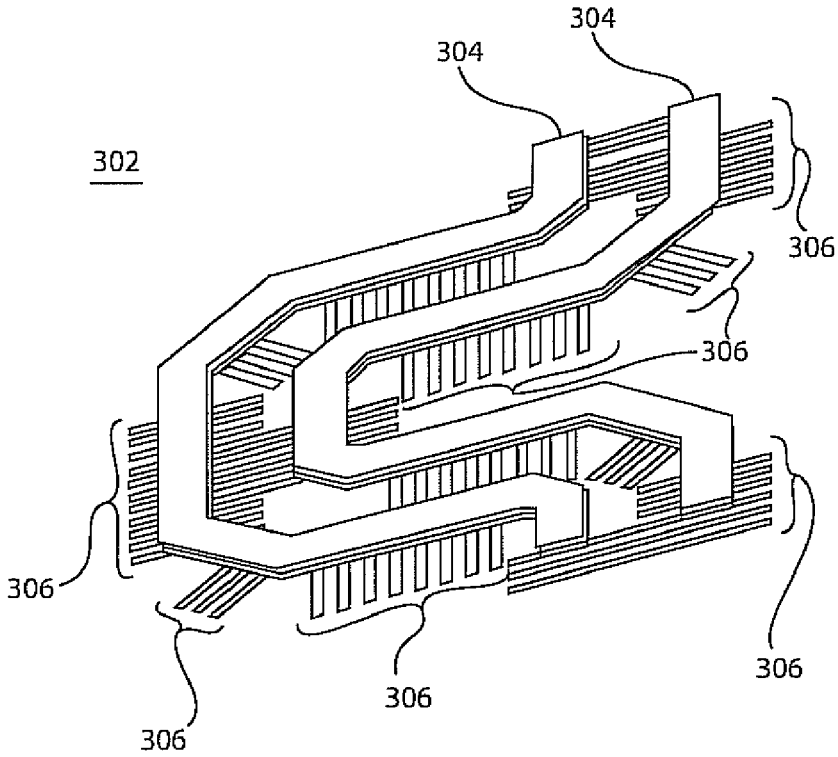
FIG. 7A is an exemplary layout of a differential coupled-CPS-based hybrid employed in a phase shifter ill accordance with one embodiment.
Figure 7B:
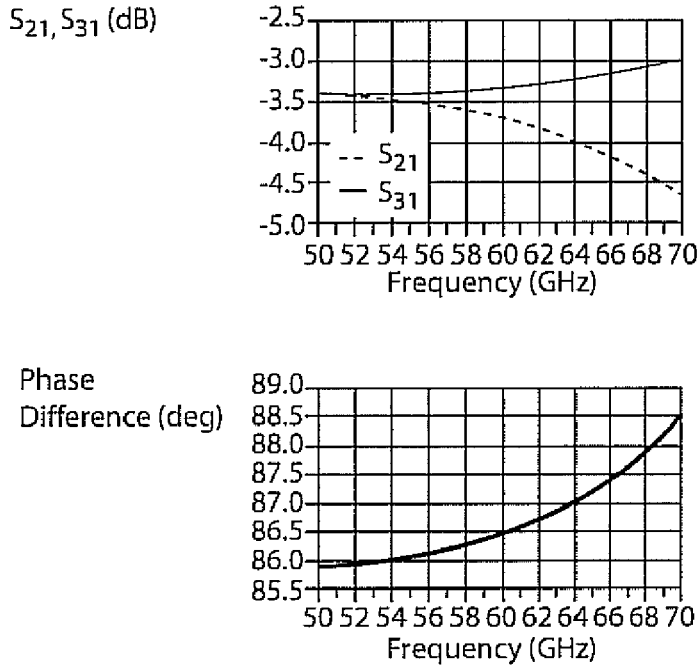
FIG. 7B are graphs showing results (power between differential ports 1 and 2 ($S_{12}$) and 1 and 3 ($S_{13}$) and phase difference) of an electromagnetic simulation of the coupled-CPS hybrid in accordance with the present principles.

Referring to FIG. 7A, an exemplary layout 302 of a differential coupled-CPS-based hybrid employed in a RTPS is illustratively shown. The hybrid is bent to conserve chip area. The coupler 302 includes two striplines 304 each including two metal layers (see FIG. 6). The coupler 302 includes coupled lines 304 with grounding strips 306 in another metal layer. FIG. 7B depicts the results of electromagnetic simulations of the coupled-CPS hybrid. Ports 1, 2, 3 and 4 represent the differential input port, coupled port, through port and isolated port, respectively as shown in, e.g., FIG. 2 and FIG. 3. The transfer functions from the through ($S_{31}$) and coupled ports ($S_{21}$) to the input are, e.g., −3.3 and −3.7 dB shown in one graph of FIG. 7B. The phase difference (degrees) between the transfer functions from the input to the coupled and through ports is also seen in the other graph of FIG. 7B to be close to 90° in the simulations.

Figure 8:
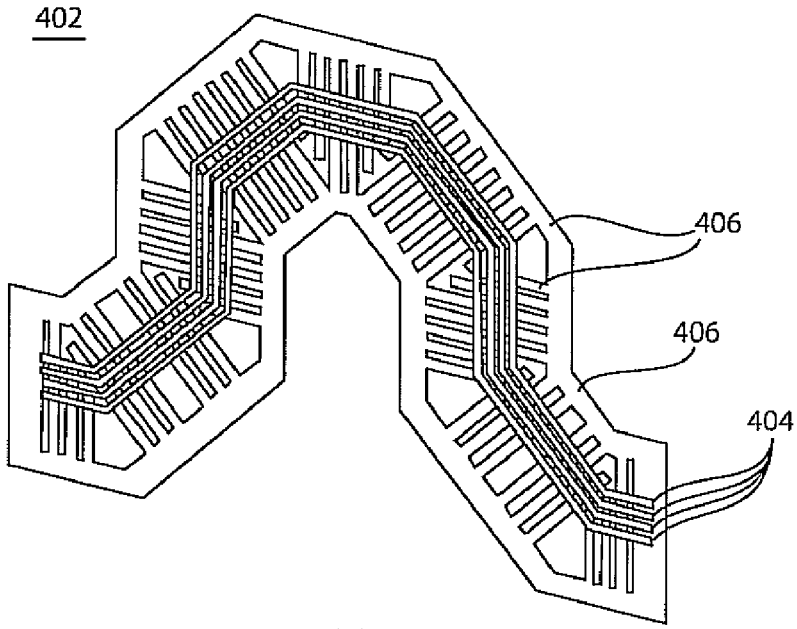
FIG. 8 is an exemplary layout of a single-ended coupled-CPS-based hybrid employed in a phase shifter in accordance with the present principles.

Referring to FIG. 8, an illustrative single-ended RTPS coupler layout 402 is illustratively shown. The coupler 402 includes coupled lines 404 with grounding strips 406 in another metal layer. The grounding strips 406 are perpendicular to the coupled lines 404. The presence of the orthogonal metal strips 406 that are discontinuous results in higher even mode impedance in the coupled lines 404 as compared to a continuous "ground plane". This results in a higher even-to-odd mode impedance in the coupled lines 404, resulting in tighter coupling, improved isolation and higher characteristic impedance in the coupler 402.

Figure 9A:
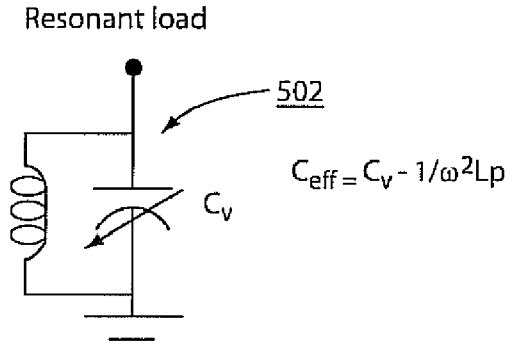
FIG. 9A is a schematic diagram showing a shunt LC termination employed as a reflective termination in accordance with one embodiment.
Figure 9B:
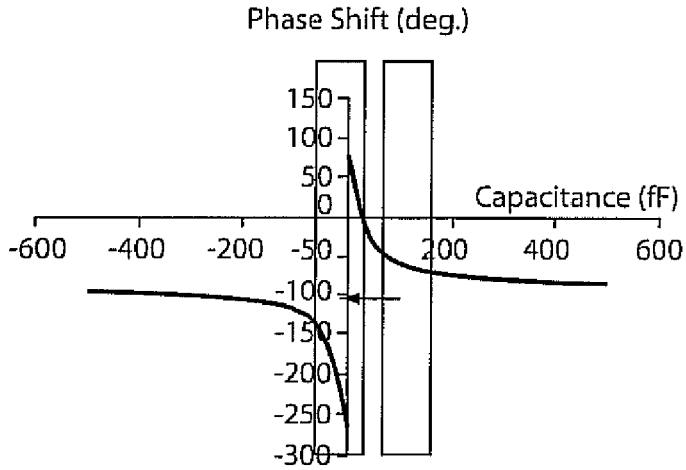
FIG. 9B is a graph which shows the resultant phase shift as a function of capacitance for the placement of a 100 pH inductor in shunt with a capacitance that varies from 50 fF to 100 fF to increase the phase shift range to 180 degrees at 60 GHz in accordance with one illustrative embodiment.

Referring to FIG. 9A, a parallel LC termination 502 is employed to implement the RTPS along with the hybrid coupler 302 (FIG. 7). FIG. 9B shows how the placement of the parallel inductor (Lp) shifts the range of phases that can be attained for a given amount of parallel capacitance (Cv). The effective capacitance in FIG. 9A is determined by: $C_{eff}=Cv-1/\omega^2Lp$. In the single-ended embodiment, one side of each LC termination is connected to the appropriate port in the coupler and the other one is connected to ground. In the differential embodiment, different element placements yield to an equivalent parallel differential LC termination. One option is to employ two single-ended parallel LC networks at each differential port of the coupler. Another option is to have the inductor connected differentially at the port and the capacitors connected in a single-ended way. This flexibility in the configuration is apparent for any skilled in the art. In one illustrative embodiment, the inductor Lp may include a 100 pH inductance and the capacitance may be varied between 50 fF and 100 fF to increase the phase shift range to 180 degrees at 60 Hz as shown in FIG. 9B. For example, a change from 50 f to 100 f transforms to −20 f to 30 f by 100 pH in parallel, resulting in the 180 degree phase change. The resonant load allows one to move the achieved capacitance range to the region of maximum phase change.

Figure 10A:
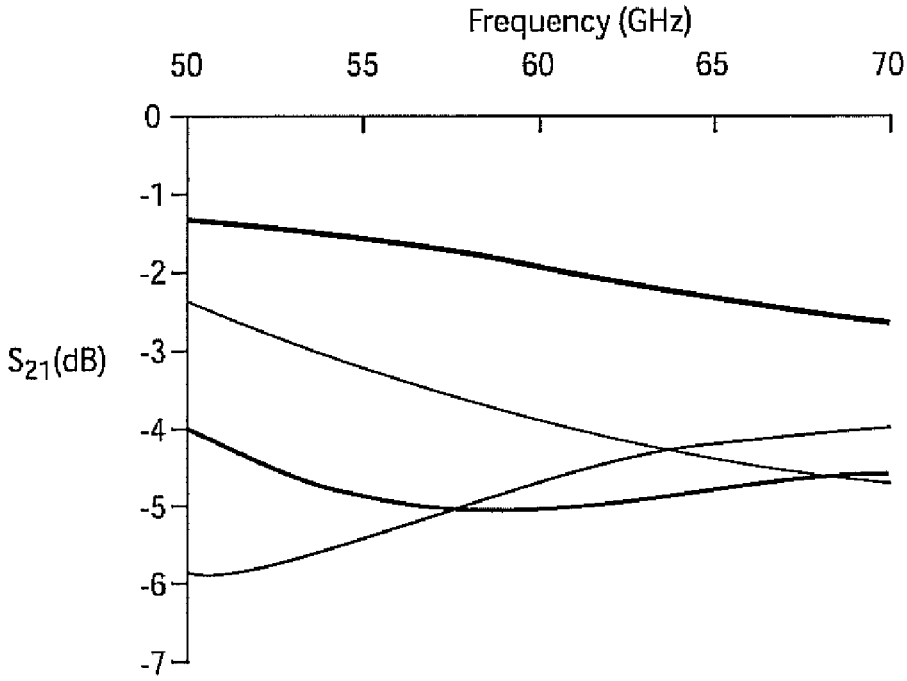
FIG. 10A is a graph showing insertion loss of the designed 60 GHz RTPS for different phase-shift settings.
Figure 10B:
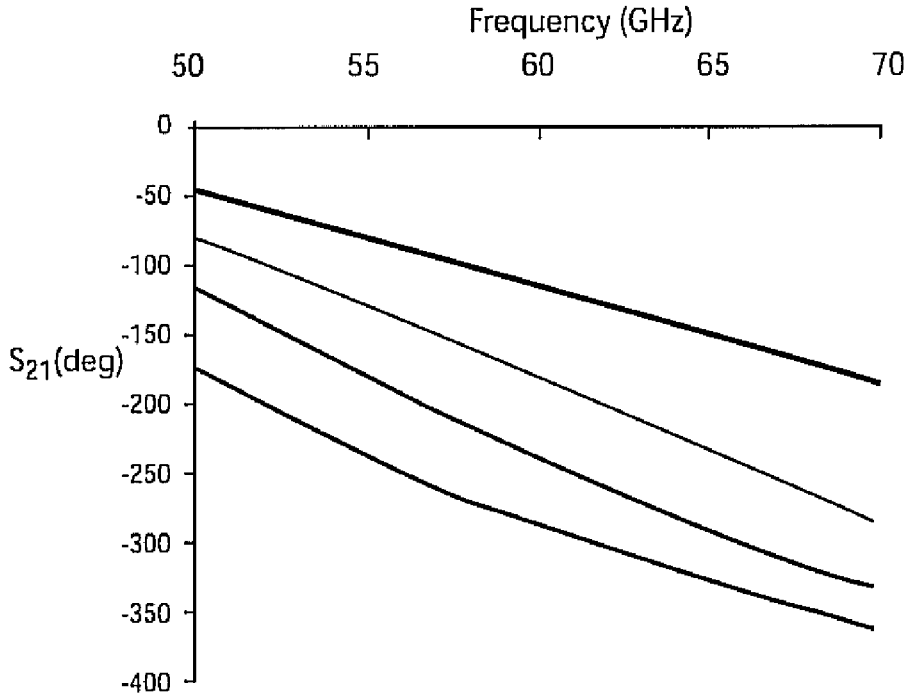
FIG. 10B is a graph showing insertion phase of the designed 60 GHz RTPS for different phase-shift settings.

Based on the differential coupled-CPS coupler and shunt LC reflective terminations, a 60 GHz RTPS is designed. The results of an electromagnetic simulation of the RTPS are shown in FIGS. 10A and 10B. For the reflective terminations, the varactor size is chosen to yield a capacitance that varies 24 to 66 fF and the varactor is shunted with a 150 pH inductor. The Q of the inductor is approximately 45 based on electromagnetic simulations and the Q of the varactor is assumed to be 9 in the maximum-capacitance state. The resultant insertion loss and insertion phase for different varactor control voltages are shown in FIGS. 10A and 10B, respectively. The maximum insertion loss in the 57-64 GHz frequency range across different phase-shift settings is 5.1 dB.

Figure 11:
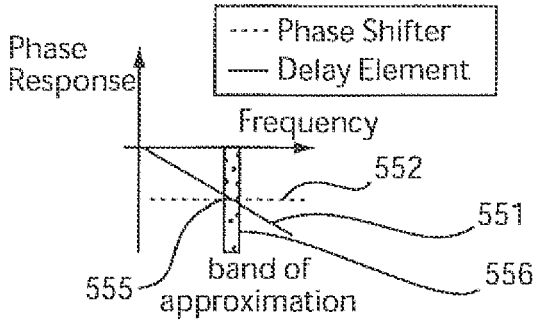
FIG. 11 is a block diagram showing a delay-phase-shift approximation for employing phase shifters as opposed to delay elements in relatively narrowband phased arrays in accordance with the present principles.

Referring to FIG. 11, a graph showing a delay/phase shift approximation is illustratively shown. Instead of delay elements, phase shifters may be employed to shift signals sent or received by antennae. Phase response is plotted for a delay element 551 and for a phase shifter 552. At the intersection 555 of the two, a frequency band 556 is provided where the substitution of phase shifters for delay elements is permissible and achieved.

Figure 12:
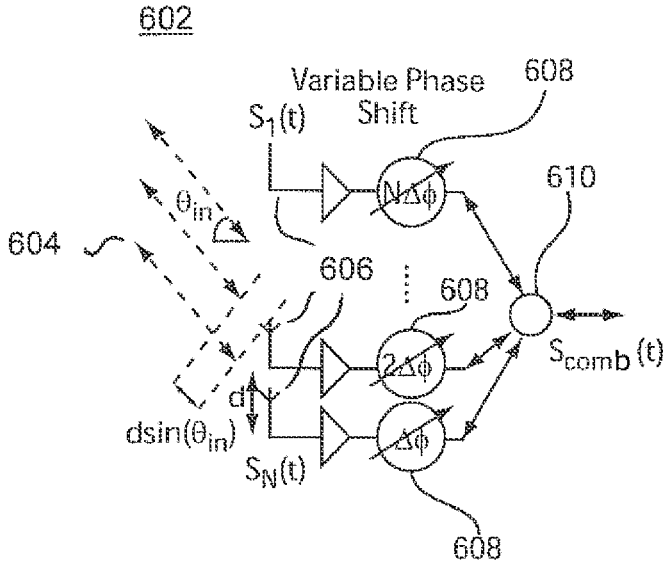
FIG. 12 is a block diagram showing a phase array transceiver in accordance with one embodiment.

Referring to FIG. 12, a block diagram illustrates a 1-D N-element phased array transceiver 602, with an inter-element antenna spacing of $d=\lambda/2$, where $\lambda$ is the free-space wavelength corresponding to the frequency of operation, $\omega$. When a signal 604 of amplitude A from an electromagnetic beam is incident to or sent from the array 602 at an angle $\theta_{in}$ (measured from the normal direction), the electromagnetic wave experiences a time delay in reaching the successive antennas 606 or reaching a receiver when transmitting. It should be noted that the present principles are applicable to a receiver and/or a transmitter operated alone or together. Variable phase shifters 608 in each signal path in the receiver compensate for this propagation delay. In this way, with appropriate adjustment at each element, the combined output signal (or the pre-distributed input signal for transmission) $S_{comb}(t)$ from summer/splitter 610 will have a larger amplitude than it could be obtain with a single element when acting as a receiver. The phased array factor (AF), in the context of receivers, is defined as the additional power gain achieved by the array over a single-element receiver.

The phased array factor is a function of the angle of incidence ($\theta$) and the array's progressive delay difference expressed here in terms of phase shift, and hence reflects the spatial selectivity of the array. The beam-pointing direction $\theta_m$ is the incident angle corresponding to maximum power gain.

In addition, in the case of receivers, a phased array enhances the signal-to-noise ratio (SNR) by a factor of 10 log(N) assuming uncorrelated noise at each antenna, due to the coherent addition of received signals and the non-coherent addition of noise. In this case, N represents the SNR to be enhanced. In the context of transmitters, the phased array enhances the Effective Isotropic Radiated Power (EIRP) by a factor of 20 log(N) due to coherent addition of the signals transmitted by the antennas. In relatively narrowband phased arrays, a variable delay element that is required for each signal path is approximated with a variable phase shifter 608 in accordance with the present principles.

A key differentiator of millimeter wave (mmWave) technology is the ability of sensing or transmitting electromagnetic energy in a particular direction. This property (directivity) is essential for non-line-of-sight wireless communication systems and radars, which have started to be implemented on silicon in recent years. Directivity is the result of having multiple antennas and the ability to change the phase of the signal coming form or being sent to each antenna element. A phase shifter circuit with convenient properties for silicon integration for phased array integrated circuits is desired.

Having described preferred embodiments of an integrated millimeter wave phase shifter and method (which are intended to be illustrative and not limiting), it is noted that modifications and variations can be made by persons skilled in the art in light of the above teachings. It is therefore to be understood that changes may be made in the particular embodiments disclosed which are within the scope and spirit of the invention as outlined by the appended claims. Having thus described aspects of the invention, with the details and particularity required by the patent laws, what is claimed and desired protected by Letters Patent is set forth in the appended claims.

What is claimed is:

1. A phase shifter, comprising:

a hybrid coupler being ground shielded including differential coplanar striplines (CPS) placed one on top of the other using different metal layers so that signal coupling occurs vertically; and reflective terminations being connected to the hybrid coupler such that when the hybrid coupler is connected to the reflective terminations a phase shifter is formed, the reflective terminations each include a parallel LC circuit.

2. The phase shifter as recited in claim 1, wherein each parallel LC circuit includes a varactor and an inductor connected in parallel such that the varactor is controlled to control a phase shift provided by the phase shifter.

3. The phase shifter as recited in claim 1, wherein the differential CPS are formed on a substrate having a major plane surface and the CPS are disposed on the major plane surface and are bent in the major plane surface.

4. The phase shifter as recited in claim 1, wherein planar widths of the CPS that are stacked on top of each other are not identical.

5. The phase shifter as recited in claim 3, further comprising metal strips placed orthogonally with respect to the CPS to provide grounding.

6. The phase shifter as recited in claim 1, wherein the phase shifter is configured for operation at millimeter-wave frequencies.

7. A method for phase shifting a received signal, comprising:

receiving a signal using one or more antennae;

phase shifting the signal by an amount dependent on a phase shifter associated with each antennae, each said phase shifter including a hybrid coupler being ground shielded, wherein each said hybrid coupler includes coupled lines placed over or under metal strips that are disposed orthogonally to the coupled lines, and reflective terminations connected to each said hybrid coupler, wherein each said reflective termination include a parallel LC circuit; and combining phase shifted signals received by the one or more antennae to provide spatial selectivity through phase shifted differences.

8. A method for phase shifting a transmitted signal, comprising:

distributing a signal to one or more antennae;

phase shifting the signal by an amount dependent on a phase shifter associated with each antennae, each said phase shifter including a hybrid coupler being ground shielded, wherein each said hybrid coupler includes coupled lines placed over or under metal strips that are disposed orthogonally to the coupled lines and reflective terminations connected to each said hybrid coupler, wherein each said reflective termination include a parallel LC circuit; and transmitting the phase shifted signals from the one or more antennae to provide spatial selectivity through phase shifted differences.

9. A phased array system, comprising:

one or more antennae configured to receive/transmit a signal;

a phase shifter associated with each antennae, each phase shifter comprising:

a hybrid coupler being ground shielded including differential coplanar striplines (CPS) placed one on top of the other using different metal layers so that signal coupling occurs vertically; and reflective terminations connected to the hybrid coupler, wherein the reflective terminations include a parallel LC circuit.

10. The phase shifter as recited in claim 9, further comprising a combiner coupled to each of said phase shifters to combine phase shifted signals received by the one or more antennae.

11. The phase shifter as recited in claim 9, wherein each said differential CPS are formed on a substrate having a major plane surface and each said CPS are disposed on the major plane surface and are bent in the major plane surface.

12. The phase shifter as recited in claim 9, wherein planar widths of each said CPS that are stacked on top of each other are not identical.

13. The phase shifter as recited in claim 11, further comprising metal strips placed orthogonally with respect to each said CPS to provide grounding.

14. The phase shifter as recited in claim 9, wherein each parallel LC circuit includes a varactor and an inductor connected in parallel such that the varactor is controlled to control a phase shift provided by the phase shifter.

15. A phase shifter, comprising:

a hybrid coupler being ground shielded including coupled lines placed over or under metal strips that are disposed orthogonally to the coupled lines; and reflective terminations being connected to the hybrid coupler such that when the hybrid coupler is connected to the reflective terminations said phase shifter is formed, the reflective terminations each include a parallel LC circuit.

16. The phase shifter as recited in claim 15, wherein the phase shifter is used for at least one of receiving and transmitting.

17. The phase shifter of claim 15, wherein the phase shifter is a part of a phased array system and is associated with an antenna configured to receive/transmit a signal.

18. A method for phase shifting a received signal, comprising:

receiving a signal using one or more antennae;

phase shifting the signal by an amount dependent on a phase shifter associated with each antennae, each phase shifter including a hybrid coupler being ground shielded and reflective terminations connected to the hybrid coupler, each said hybrid coupler including differential coplanar striplines (CPS) placed one on top of the other using different metal layers so that signal coupling occurs vertically, wherein each of said reflective termination includes a parallel LC circuit; and combining phase shifted signals received by the one or more antennae to provide spatial selectivity through phase shifted differences.

19. The method as recited in claim 18, further includes forming each said differential CPS on a substrate having a major plane surface where each said CPS are disposed on the plane surface and are bent in the major plane.

20. The method as recited in claim 18, wherein planar widths of each said CPS that are stacked on top of each other are not identical.

21. The method as recited in claim 18, further comprising placing metal strips orthogonally with respect to each said CPS to provide grounding.

22. The method as recited in claim 18, wherein each parallel LC circuit includes a varactor and an inductor connected in parallel and the method further includes controlling each said varactor to control a phase shift provided by the phase shifter.

23. A method for phase shifting a transmitted signal, comprising:

distributing a signal to one or more antennae;

phase shifting the signal by an amount dependent on a phase shifter associated with each antennae, each phase shifter including a hybrid coupler being ground shielded and reflective terminations connected to the hybrid coupler, each said hybrid coupler including differential coplanar striplines (CPS) placed one on top of the other using different metal layers so that signal coupling occurs vertically, wherein each of said reflective termination includes a parallel LC circuit; and transmitting the phase shifted signals from the one or more antennae to provide spatial selectivity through phase shifted differences.

24. The method as recited in claim 23, further includes forming each said differential CPS on a substrate having a major plane surface where each said CPS are disposed on each of said reflective termination includes.

* * * * *